US007517259B2

(12) United States Patent
Chiu

(10) Patent No.: US 7,517,259 B2
(45) Date of Patent: Apr. 14, 2009

(54) ELECTRIC POWER CONNECTOR

(75) Inventor: Shu-Yi Chiu, Panchiao (TW)

(73) Assignee: Alltop Technology Co., Ltd., Jhonghe (TW)

( * ) Notice: Subject to any disclaimer, the term of this patent is extended or adjusted under 35 U.S.C. 154(b) by 0 days.

(21) Appl. No.: 11/844,340

(22) Filed: Aug. 23, 2007

(65) Prior Publication Data

US 2008/0200054 A1 Aug. 21, 2008

(30) Foreign Application Priority Data

Feb. 16, 2007 (TW) ..... 096203107 U

(51) Int. Cl.
*H01R 13/40* (2006.01)

(52) U.S. Cl. ..... 439/752.5; 439/79

(58) Field of Classification Search ..... 439/752.5, 439/79, 80, 246, 248, 869, 733
See application file for complete search history.

(56) References Cited

U.S. PATENT DOCUMENTS 6,179,660 B1 * 1/2001 Salaguinto et al. ..... 439/595
6,685,361 B1 * 2/2004 Rubino et al. ..... 385/58
6,872,008 B2 * 3/2005 Takeda et al. ..... 385/60
6,994,598 B2 * 2/2006 Holmes et al. ..... 439/752.5
7,347,745 B1 * 3/2008 Raudenbush et al. ..... 439/752
7,371,131 B2 * 5/2008 Houtz ..... 439/751

* cited by examiner

*Primary Examiner*—Hien Vu
(74) *Attorney, Agent, or Firm*—Sughrue Mion, PLLC

(57) ABSTRACT

An electric power connector includes an electrically insulative housing, which has a receiving chamber for receiving a matching socket type electric connector, a plug portion disposed at the rear side inside the receiving chamber, a plurality of countersunk holes cut through the plug portion, multiple ribs disposed in each countersunk hole, and two positioning portions disposed at two opposite lateral sides inside the receiving chamber to guide connection of the electric power connector to the matching socket type electric connector, and conducting terminals respectively mounted in the countersunk holes of the housing, each conducting terminal having a positioning portion positioned in the associating countersunk hole and engaged with the ribs in the associating countersunk hole, a front contact portion forwardly extending from the positioning portion and suspending in the receiving chamber for inserting into one contact hole of the matching socket type electric connector, and a rear bonding portion backwardly extending from the positioning portion through the associating countersunk hole to the outside of the housing and bonded to a circuit board.

17 Claims, 6 Drawing Sheets

ELECTRIC POWER CONNECTOR

This application claims the priority benefit of Taiwan patent application number 096203107 filed on Feb. 16, 2007.

BACKGROUND OF THE INVENTION

1. Field of the Invention

The present invention relates to electric connectors and more particularly, to an electric power connector, which prohibits displacement or rotation of the conducting terminal relative to the housing during installation, preventing tearing off of the metal conducting coating of the conducting terminals and assuring positive electric connection to a matching socket type electric connector.

2. Description of the Related Art

Following fast development of computer technology, different advanced electronic devices have been continuously developed to bring convenience to people. These advanced electronic devices use complicated circuit boards and different electric connectors for communication with peripheral apparatus. For example, an electronic device may have electric power connector, audio terminal connector, USB connector, RJ connector, memory card connector, etc., for the connection of power source and peripheral apparatus.

FIG. 6 shows an electric power connector according to the prior art. According to this design, the electric power connector comprises an electrically insulative housing A and a set of conducting terminals B. The housing A comprises a receiving chamber A1 for receiving a matching electric connector, and a plurality of through holes A2 cut through the rear wall in communication with the receiving chamber A1. The conducting terminals B are respectively mounted in the through holes A2 of the housing A, each having a front contact end suspending in the receiving chamber A1 and a rear bonding end extending out of the housing A for bonding to an external circuit board. According to this design, the conducting terminals B are cylindrical metal wire rods each having a smooth outer surface. The conducting terminals B are positioned in the through holes A2 by means of friction engagement. Frequently inserting the conducting terminals B of the electric power connector into the respective contact holes A2 of the matching electric connector and disconnecting the conducting terminals B of the electric power connector from the respective contact holes A2 of the matching electric connector may cause displacement or rotation of the conducting terminals B relative to the housing A, resulting in a connector error or unstable power transmission.

Therefore, it is desirable to provide an electric connector that eliminates the aforesaid drawbacks.

SUMMARY OF THE INVENTION

The present invention has been accomplished under the circumstances in view. It is the main object of the present invention to provide an electric power connector, which prohibits rotation of the conducting terminals relative to the housing. It is another object of the present invention to provide an electric power connector, which prohibits axial displacement of the conducting terminals relative to the housing.

To achieve these and other objects of the present invention, the electric power connector comprises an electrically insulative housing, which has a receiving chamber for receiving a matching socket type electric connector, a plug portion disposed at the rear side inside the receiving chamber, a plurality of countersunk holes cut through the plug portion, multiple ribs disposed in each countersunk hole, and two positioning portions disposed at two opposite lateral sides inside the receiving chamber to guide connection of the electric power connector to the matching socket type electric connector, and conducting terminals respectively mounted in the countersunk holes of the housing, each conducting terminal having a positioning portion positioned in the associating countersunk hole and engaged with the ribs in the associating countersunk hole, a front contact portion forwardly extending from the positioning portion and suspending in the receiving chamber for inserting into one contact hole of the matching socket type electric connector, and a rear bonding portion backwardly extending from the positioning portion through the associating countersunk hole to the outside of the housing and bonded to a circuit board. By means of engagement between the ribs in each countersunk hole of the housing and engagement grooves of the positioning portion of each conducting terminal, the conducting terminals are prohibited from rotation relative to the housing, preventing tearing off of the metal conducting coating of the conducting terminals upon insertion of the conducting terminals into the respective contact holes of the matching socket type electric connector. Further, the countersunk holes of the housing each have a wide outer portion for receiving the positioning portions of the conducting terminals respectively and a narrow inner portion for the passing of the rear bonding portions of the conducting terminals to the outside of the housing for bonding to the circuit board respectively. Therefore, the conducting terminals are prohibited from axial displacement relative to the housing, preventing disconnection of the rear bonding portions of the conducting terminals from the circuit board.

DETAILED DESCRIPTION OF THE PREFERRED EMBODIMENT

Figure 1:
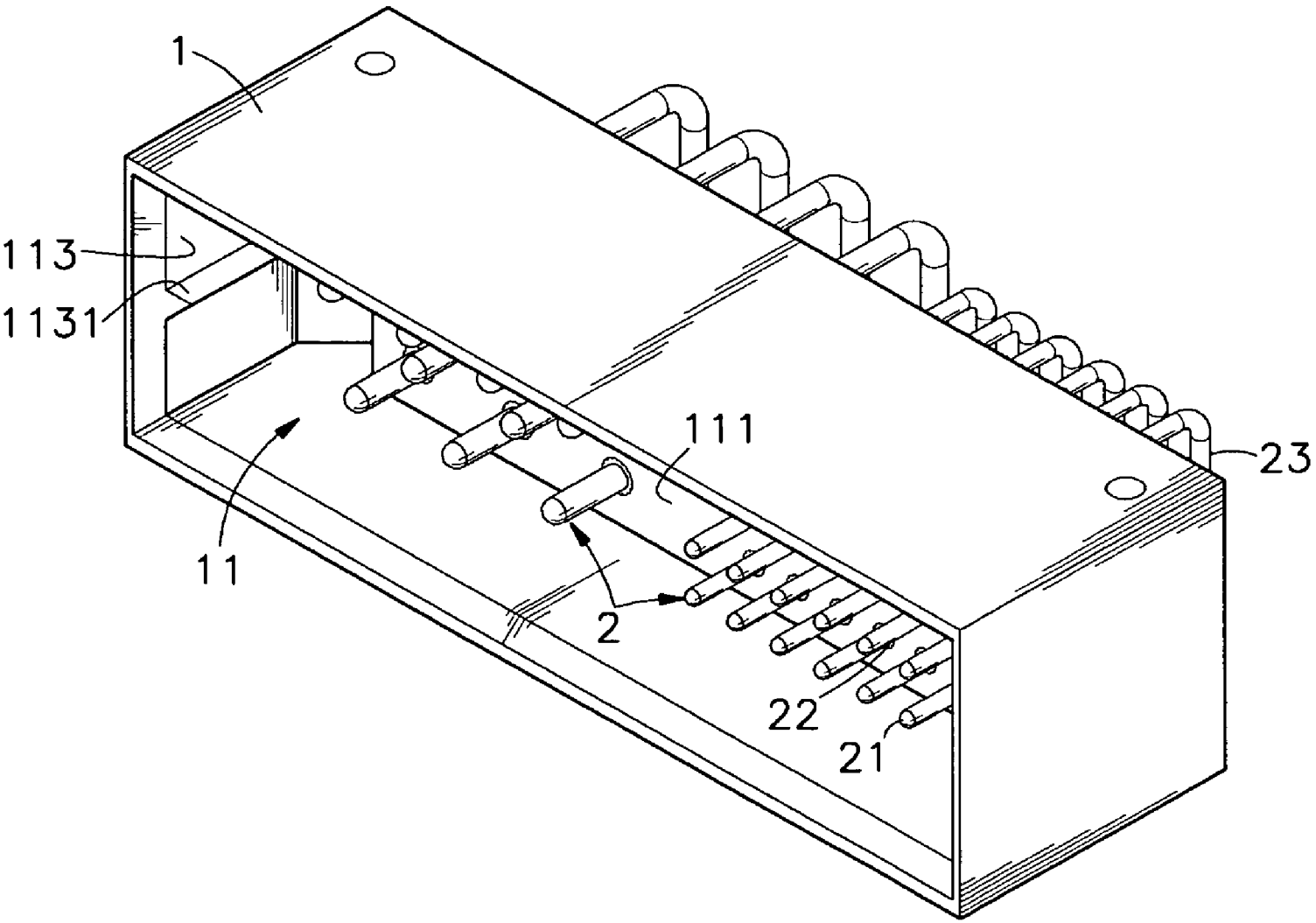
FIG. 1 is an elevational view of an electric power connector in accordance with the present invention.
Figure 2:
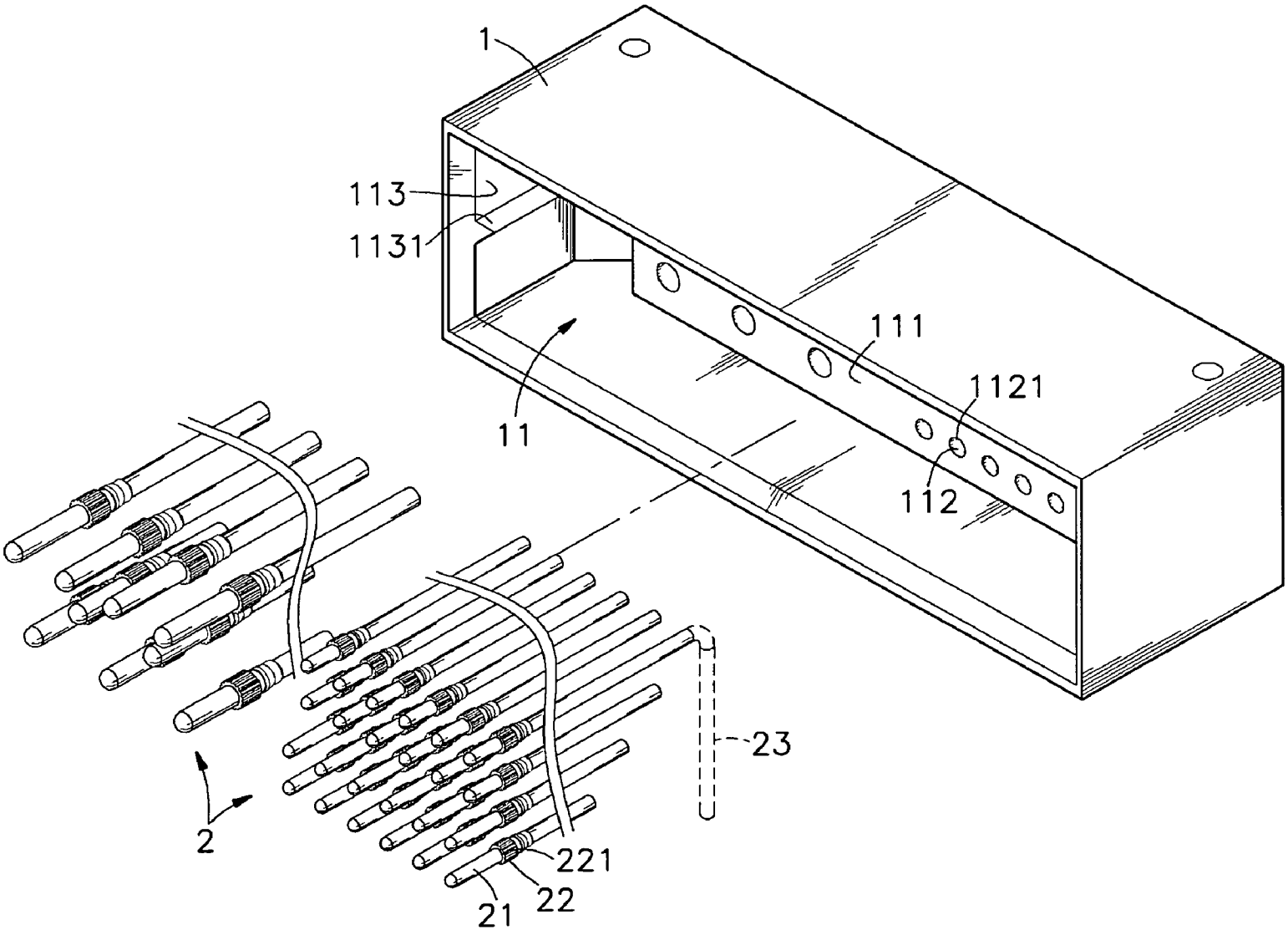
FIG. 2 is an exploded view of the electric power connector in accordance with the present invention.
Figure 3:
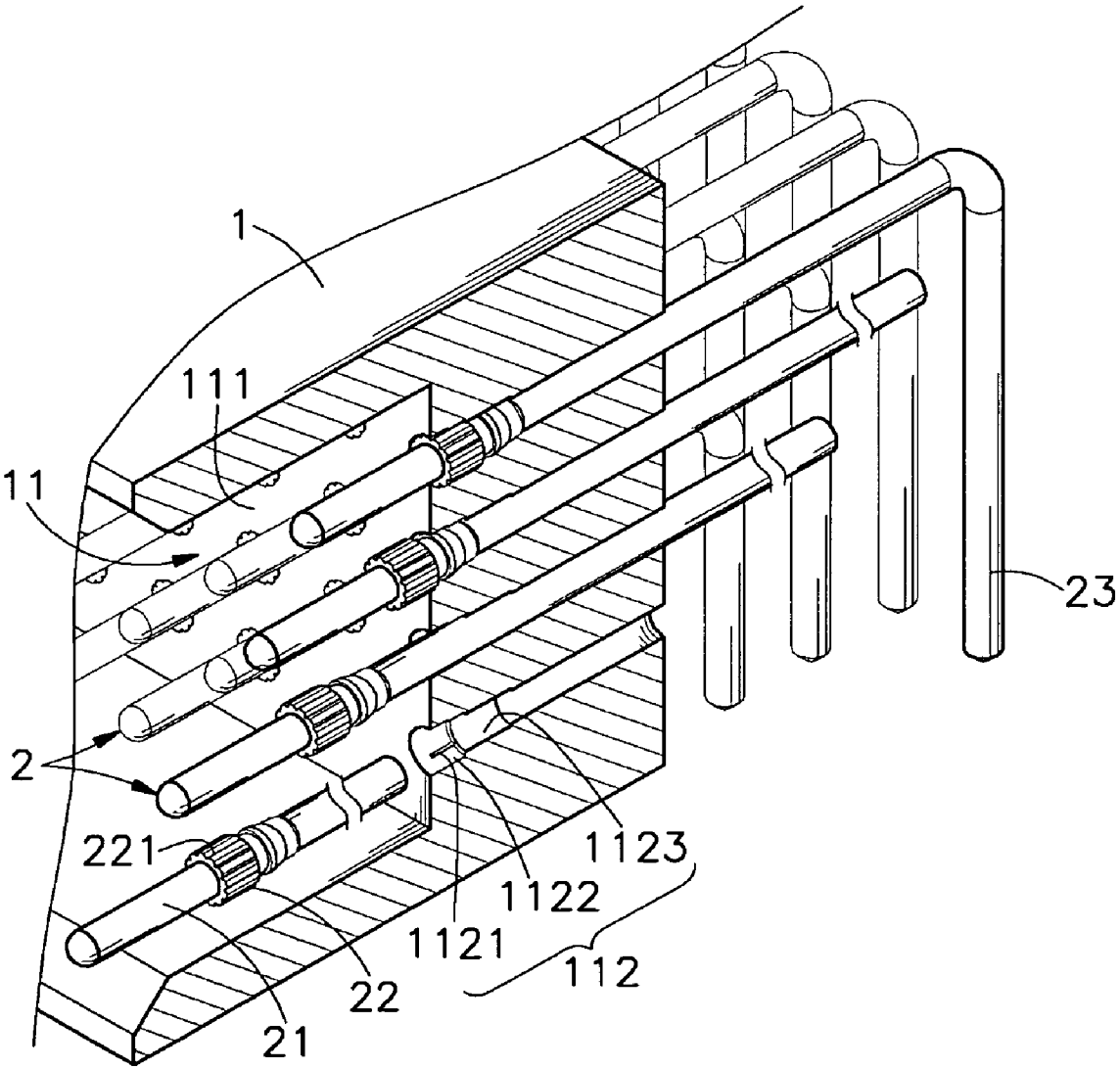
FIG. 3 is a sectional elevation in an enlarged scale of a part of the electric power connector shown in FIG. 1.

Referring to FIGS. 1~5, an electric power connector in accordance with the present invention is a plug type connector comprising a housing 1 and a set of conducting terminals 2.

The housing 1 comprises a receiving chamber 11 for receiving a matching socket type electric connector 4, a plug portion 111 suspending in the rear side of the receiving chamber 11, a plurality of countersunk holes 112 cut through the plug portion 111, a plurality of ribs 1121 respectively suspending in the countersunk holes 112, and two positioning portions 113 symmetrically disposed at two opposite lateral sides inside the receiving chamber 11. Each positioning portion 113 comprises at least one elongated guide flange 1131 disposed in parallel to the extending direction of the countersunk holes 112.

The conducting terminals 2 are respectively mounted in the countersunk holes 112 of the housing 1, each having a front contact portion 21 respectively extending out of the countersunk holes 112 and suspending in the receiving chamber 11, a positioning portion 22 respectively positioned in the countersunk holes 112, a plurality of engagement grooves 221 formed on the positioning portion 22 and respectively engaged with the ribs 1121 in the countersunk holes 112, and a rear bonding portion 23 extending out of the housing 1 and bonded to a circuit board 3.

The aforesaid housing 1 is directly molded from an electrically insulative material. The countersunk holes 112 of the housing 1 each have a wide outer portion 1122 for receiving the positioning portions 22 of the conducting terminals 2 respectively and a narrow inner portion 1123 for the passing of the rear bonding portion 23 to the outside of the housing 1. The ribs 1121 are respectively disposed in the wide outer portions 1122 of the countersunk holes 112, and the wide outer portions 1122 can be made having circular, oval, rectangular or polygonal cross section. Further, the rear bonding portions 23 of the conducting terminals 2 may be bonded to the circuit board 3 by means of through-hole bonding or SMT (surface mounting technology). Further, the ribs 1121 of the housing 1 fit the engagement grooves 221 of the positioning portion 22 of the conducting terminals 2 in shape. Further, the positioning portion 22 of the conducting terminals 2 can be made having protrusions and grooves of arched, rectangular or triangular cross section.

Figure 4:
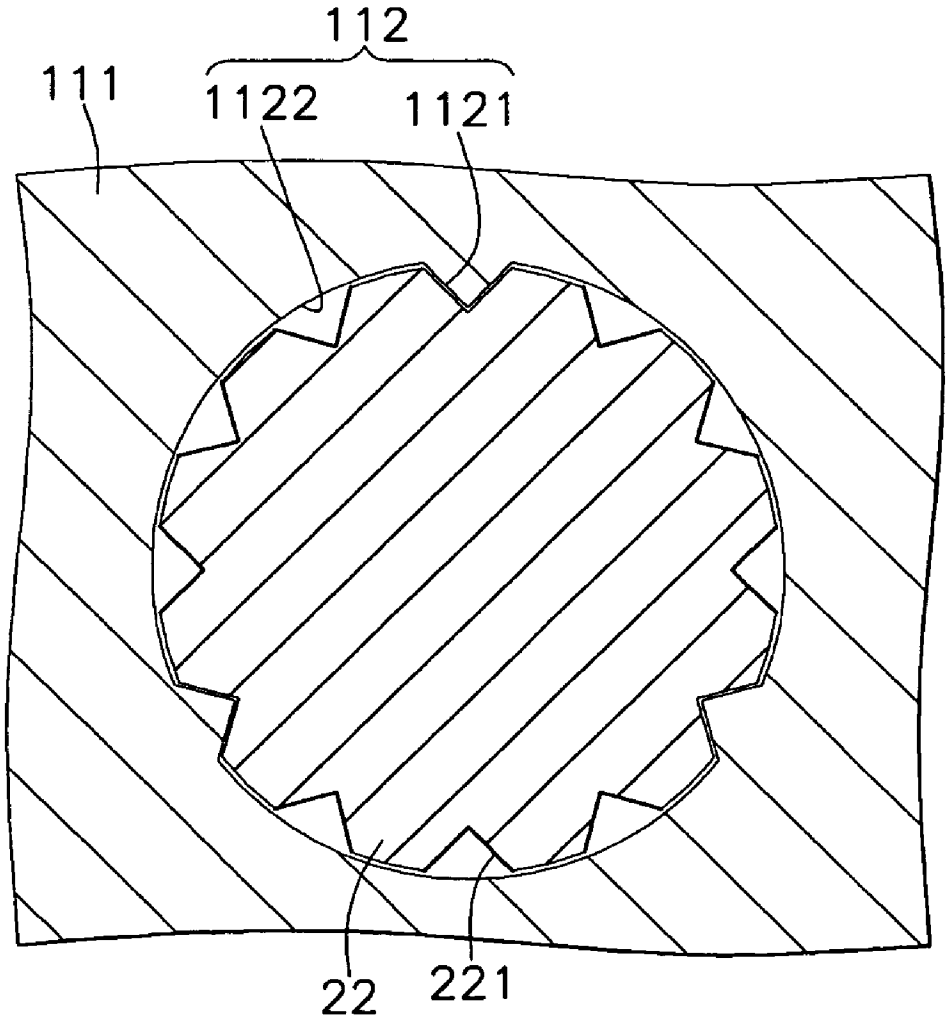
FIG. 4 is a cross sectional view in an enlarged scale of a part of FIG. 1, showing engagement between the engagement grooves of one conducting terminal and the ribs in the associating countersunk hole of the housing.
Figure 5:
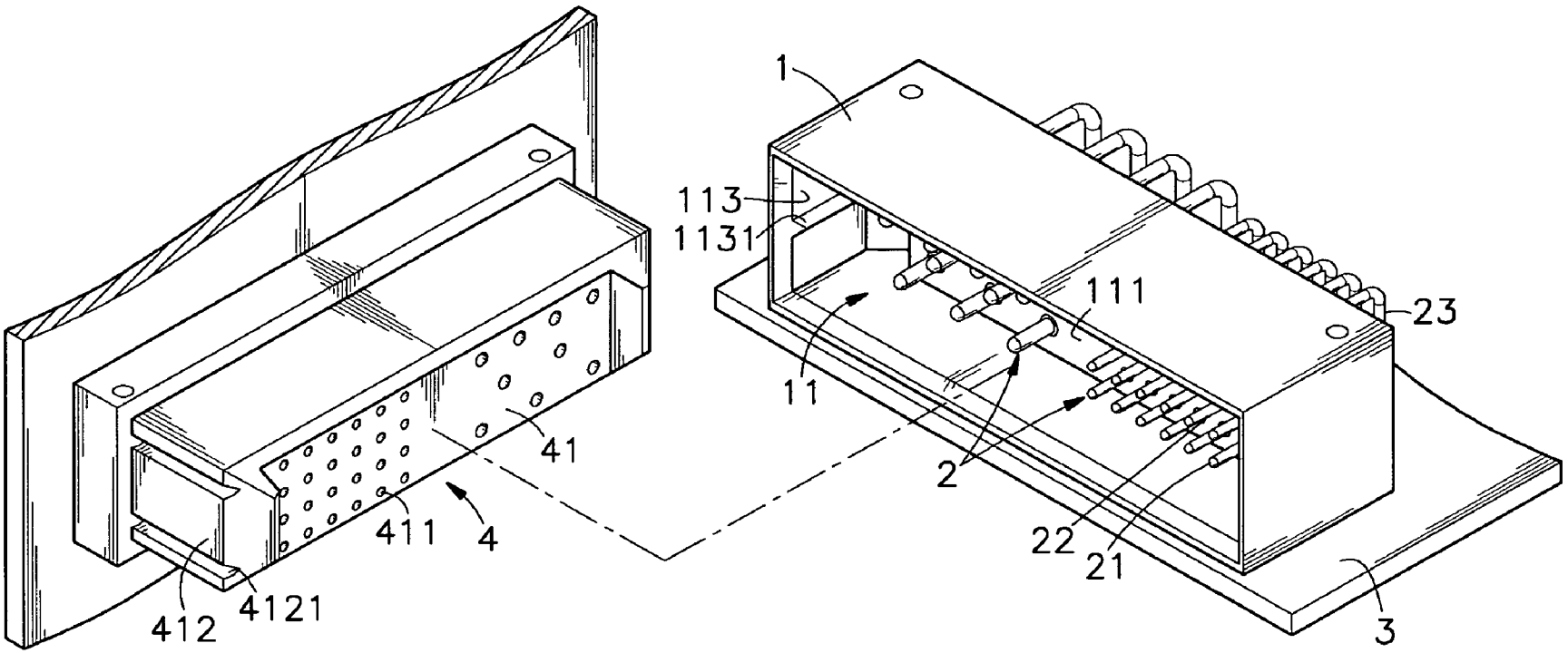
FIG. 5 is an applied view of the present invention, showing the electric power connector bonded to a circuit board before connection to a matching socket type electric connector.
Figure 6:
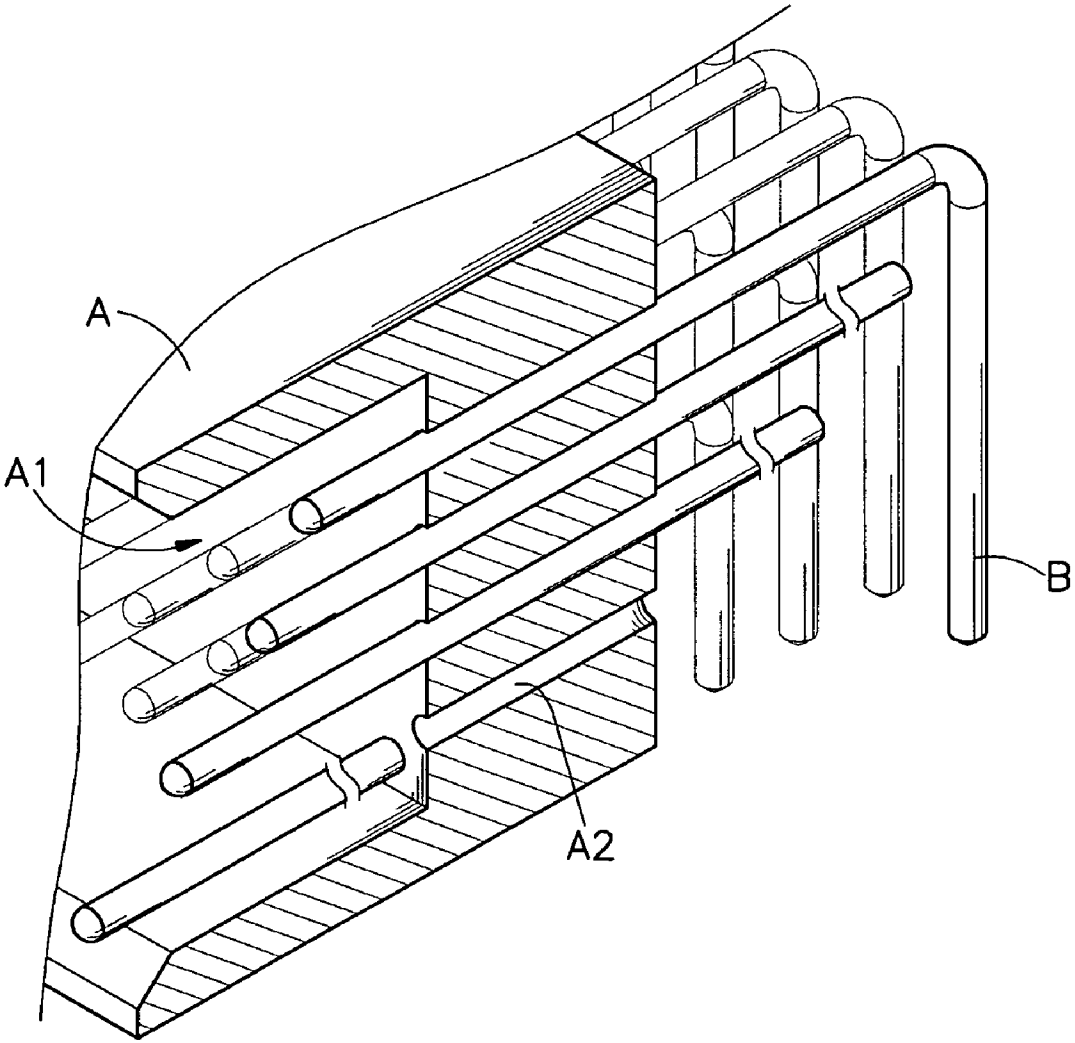
PRIOR ART FIG. 6
FIG. 6 is a sectional elevation of an electric power connector according to the prior art.

During assembly process, the conducting terminals 2 are respectively inserted through the countersunk holes 112 of the housing 1 to have the front contact portions 21 of the conducting terminals 2 suspend in the receiving chamber 11 of the housing 1 and the positioning portions 22 of the conducting terminals 2 be positioned in the wide outer portions 1122 of the countersunk holes 112 and to force the respective engagement grooves 221 of the positioning portions 22 of the conducting terminals 2 into engagement with the respective ribs 1121 in the countersunk holes 112 (see FIG. 4). By means of engagement between the positioning portions 22 of the conducting terminals 2 and the wide outer portions 1122 of the countersunk holes 112 and engagement between the engagement grooves 221 of the positioning portions 22 of the conducting terminals 2 and the respective ribs 1121 in the countersunk holes 112, the conducting terminals 2 are prohibited from displacement or rotation relative to the housing 1. After installation of the conducting terminals 2 in the countersunk holes 112 of the housing 1, the rear bonding portions 23 of the conducting terminals 2 are bend downwards and respectively electrically bonded to the circuit board 3.

According to the present preferred embodiment, the number of the ribs 1121 in each countersunk hole 112 is 3, and the three ribs 1121 in each countersunk hole 112 are equiangularly spaced from one another. Further, the number of the engagement grooves 221 of the positioning portion 22 of each conducting terminal 2 is determined subject to the number of the ribs 1121. After engagement between the engagement grooves 221 of the positioning portions 22 of the conducting terminals 2 with the respective ribs 1121 in the countersunk holes 112 of the housing 1, the conducting terminals 2 are prohibited from rotation relative to the housing 1. Therefore, inserting the front contact portions 21 of the conducting terminals 2 into respective contact holes 411 of the matching socket type electric connector 4 does not produce a high friction to tear off the outer metal conducting coating of the front contact portions 21 of the conducting terminals 2.

The design of the countersunk holes 112 prohibits axial displacement of the conducting terminals 2 and enhances the strength of the conducting terminals 2 for positive installation in the matching socket type electric connector 4, preventing deformation of the conducting terminals 2 or disconnection of the rear bonding portions 23 of the conducting terminals 2 from the circuit board 3 when inserting the front contact portions 21 of the conducting terminals 2 into the respective contact holes 411 of the matching socket type electric connector 4.

Referring to FIG. 5 again, when in use, the housing 1 is attached to the matching socket type electric connector 4 to insert the front contact portions 21 of the conducting terminals 2 into the respective contact holes 411 in a socket portion 41 of the matching socket type electric connector 4, and at the same time, the two positioning portions 113 of the housing 1 are respectively coupled to respective limiting portions 412 of the matching socket type electric connector 4 to force the elongated guide flanges 1131 of the positioning portions 113 into engagement with respective guide grooves 4121 of the limiting portions 412 of the matching socket type electric connector 4. The positioning portions 113 of the housing 1 and the positioning portions 412 of the matching socket type electric connector 4 constitute a foolproof structure, preventing erroneous installation of the electric power connector in the matching socket type electric connector 4 in a wrong direction to cause damage to the conducting terminals 2.

In conclusion, the invention provides an electric power connector, which has the following features and benefits:

1. The housing 1 has three ribs 1121 equiangularly spaced in each countersunk hole 112 for the engagement of the respective engagement grooves 221 of the positioning portions 22 of the conducting terminals 2 to secure the conducting terminals 2 in place.

2. The positioning portions 22 of the conducting terminals 2 have engagement grooves 221 engaged with respective ribs 1121 in the countersunk holes 112 of the housing 1, and therefore the conducting terminals 2 are prohibited from rotation relative to the housing 1 to prevent tearing off of the outer metal conducting coating of the front contact portions 21 of the conducting terminals 2 upon insertion of the front contact portions 21 of the conducting terminals 2 into the respective contact holes 411 of the matching socket type electric connector 4, assuring high quality transmission of power.

3. The countersunk holes 112 of the housing 1 each have a wide outer portion 1122 for receiving the positioning portions 22 of the conducting terminals 2 respectively and a narrow inner portion 1123 for the passing of the rear bonding portions 23 of the conducting terminals 2 to the outside of the housing 1 respectively for bonding to the circuit board 3. During installation, the conducting terminals 2 are prohibited from axial displacement relative to the housing 1, preventing disconnection of the rear bonding portions 23 of the conducting terminals 2 from the circuit board 3.

4. The positioning portions 113 of the housing 1 and the limiting portions 412 of the matching socket type electric connector 4 constitute a foolproof structure, preventing erroneous installation of the electric power connector in the matching socket type electric connector 4 in a wrong direction to cause damage to the conducting terminals 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric power connector for connecting to contact holes of a matching socket type electric connector, comprising:

an insulative housing comprising a receiving chamber to receive said matching socket type electric connector, a plug portion disposed at a rear side inside said receiving chamber, a plurality of countersunk holes cut through said plug portion and backwardly extending from said receiving chamber to the outside of said electrically insulative housing, and two positioning portions disposed at two opposite lateral inner side walls of said receiving chamber to engage with corresponding positioning portions of the matching socket type electric connector; and a set of conducting terminals respectively mounted in said countersunk holes of said electrically insulative housing, each comprising a positioning portion respectively positioned in said associating countersunk hole, a front contact portion forwardly extending from one end of said positioning portion such that the front contact portion is suspended in said receiving chamber to insert into one contact hole of said matching socket type electric connector, and a rear bonding portion backwardly extending from an opposite end of said positioning portion through said associating countersunk hole and extending beyond a rear wall of said electrically insulative housing to the outside of said electrically insulative housing and bonded to an external circuit board;

wherein each countersunk hole has a circular cross section and at least three equiangularly spaced ribs formed on an inner wall of said countersunk hole to engage with the positioning portion of the corresponding conducting terminal to prohibit rotation of said conducting terminals relative to said housing.

2. The electric power connector as claimed in claim 1, wherein said positioning portions of said electrically insulative housing each comprise a plurality of elongated guide flanges extending in a parallel manner relative to the extending direction of said countersunk holes to couple to respective guide grooves of said matching socket type electric connector to guide said front contact portions into said respective contact holes of said matching socket type electric connector.

3. The electric power connector as claimed in claim 1, wherein the positioning portion of each conducting terminal has at least three engagement grooves engaged with said at least three ribs of the corresponding countersunk hole.

4. The electric power connector as claimed in claim 1, wherein said countersunk holes each have a wide outer portion to receive said positioning portion of said associating conducting terminal, and a narrow inner portion narrower than said wide outer portion, said rear bonding portion of said associating conducting terminal passing said wide outer portion and then said narrow inner portion to the outside of said insulative housing.

5. The electric power connector as claimed in claim 4, wherein said wide outer portion of each of said countersunk holes have a circular cross section and said at least three ribs are formed on an inner wall of said wide outer portion of each countersunk hole.

6. The electric power connector as claimed in claim 3, wherein said at least three engagement grooves have a cross-sectional profile that is the same as a cross-sectional profile of said at least three ribs.

7. An electric power connector comprising:

an insulative housing comprising a receiving chamber, a plug portion disposed at a rear side inside said receiving chamber, a plurality of countersunk holes cut through said plug portion and backwardly extending from said receiving chamber to the outside of said electrically insulative housing, said countersunk holes each having a circular cross section and at least three equiangularly spaced ribs formed on an inner wall of each of said countersunk holes; and a set of conducting terminals respectively mounted in said countersunk holes of said electrically insulative housing, each comprising a positioning portion with a circular cross section and respectively engaged with said equiangularly spaced ribs, and a front contact portion forwardly extending from one end of said positioning portion such that the front contact portion is suspended in said receiving chamber;

wherein the positioning portion of each conducting terminal has at least three engagement grooves to engage with the at least three equiangularly spaced ribs formed on an inner wall of each countersunk hole.

8. The electric power connector as claimed in claim 7, wherein said at least three engagement grooves have a cross-sectional profile that is the same as a cross-sectional profile of said ribs.

9. The electric power connector as claimed in claim 7, wherein each of said conducting terminals has a rear bonding portion extending from an opposite end of said positioning portion backwardly through said countersunk hole.

10. The electric power connector as claimed in claim 7, wherein said countersunk holes each have a wide outer portion to receive said positioning portion of said conducting terminal, and a narrow inner portion located behind said wide outer portion that is narrower than said wide outer portion, said rear bonding portion passing the wide outer portion and then the narrow inner portion to the outside of said insulative housing.

11. The electric power connector as claimed in claim 10, wherein said ribs are formed on an inner wall of said wide outer portion.

12. An electric power connector assembly, comprising:

an electric power connector, comprising:

an insulative housing comprising a receiving chamber, a plug portion disposed at a rear side inside said receiving chamber, a plurality of countersunk holes cut through said plug portion and backwardly extending from said receiving chamber to the outside of said electrically insulative housing, two positioning portions disposed on two opposite lateral inner side walls of said receiving chamber; and a set of conducting terminals respectively mounted in said countersunk hole of said electrically insulative housing, each comprising a positioning portion respectively positioned in said countersunk hole, a front contact portion forwardly extending from one end of said positioning portion such that the front contact portion is suspended in said receiving chamber; and a corresponding socket type electric connector matching said electric power connector, comprising:

a socket portion received in said receiving chamber, said socket portion defined with a plurality of contact holes to receive said front contact portions of said conducting terminals, two positioning portions formed on two opposite lateral outer sides of said socket portion engaged with corresponding positioning portions of said electric power connector;

wherein the countersunk holes each have a circular cross section and at least three equiangularly spaced ribs formed on an inner wall of the countersunk holes to engage with the positioning portion of the corresponding conducting terminal.

13. The electric power connector assembly as claimed in claim 12, wherein said positioning portions of said electric power connector have elongated guiding flanges protruding into said receiving chamber; and wherein said positioning portions of said socket type electric connector form guide grooves therein to couple to said guiding flanges to guide said front contact portions into said contact holes of said socket type electric connector.

14. The electric power connector assembly as claimed in claim 12, wherein the positioning portion of each conducting terminal has at least three engagement grooves engaged with said at least three equiangularly spaced ribs of the corresponding countersunk hole.

15. The electric power connector assembly as claimed in claim 14, wherein said at least three engagement grooves have a cross-sectional profile that is the same as a cross-sectional profile of said at least three ribs.

16. The electric power connector assembly as claimed in claim 14, wherein each of said conducting terminals has a rear bonding portion extending from an opposite end of said positioning portion thereof backwardly through said countersunk hole.

17. The electric power connector assembly as claimed in claim 16, wherein said countersunk holes each have a wide outer portion to receive said positioning portion of said conducting terminal, and a narrow inner portion located behind said wide outer portion and narrower than said wide outer portion, and wherein said ribs are formed on an inner wall of said wide outer portion, said rear bonding portion passing the wide outer portion and then the narrow inner portion to the outside of said insulative housing.

* * * * *